US005314179A

United States Patent [19]

Oda et al.

[11] Patent Number: 5,314,179

[45] Date of Patent: May 24, 1994

[54] PRINTING PAPER PROTECTING DEVICE

[75] Inventors: Keisuke Oda; Fumio Kouzai, both of Fukuyama, Japan

[73] Assignee: Mitsubishi Denki Kabushiki Kaisha, Tokyo, Japan

[21] Appl. No.: 921,000

[22] Filed: Jul. 28, 1992

[30] Foreign Application Priority Data

Jul. 29, 1991 [JP] Japan ..... 3-188463

[51] Int. Cl.[5] ..... B65H 1/00

[52] U.S. Cl. ..... 271/145; 206/449; 206/215

[58] Field of Search ..... 271/145; 206/449, 215

[56] References Cited

U.S. PATENT DOCUMENTS 3,767,188 10/1973 Rosenburg, Jr. et al. ..... 271/145
4,537,307 8/1985 Tamura ..... 206/449
4,830,186 5/1989 George et al. ..... 206/449
4,958,950 9/1990 Kobayashi et al. .
4,993,698 2/1991 Buelens et al. ..... 271/145

FOREIGN PATENT DOCUMENTS 0236123 9/1989 Japan ..... 271/145
0317924 12/1989 Japan ..... 271/145

*Primary Examiner*—David H. Bollinger
*Attorney, Agent, or Firm*—Leydig, Voit & Mayer

[57] ABSTRACT

A printing paper protective device includes a protecting plate having a bent portion for separating a paper stack and an open portion for detecting when the paper stack has disappeared. The protecting plate is placed on the printing surface of printing paper and is accommodated in a paper cassette together with the paper stack.

20 Claims, 14 Drawing Sheets

PRINTING PAPER PROTECTING DEVICE

BACKGROUND OF THE INVENTION

1. Field of the Invention

This invention relates to a printing paper protecting device which is capable of preventing the printing surface of printing paper, such as sublimation type printing paper, from being soiled during transportation or loading into a paper cassette.

2. Description of the Related Art

FIG. 16 is a perspective view illustrating an example of how a stack of conventional printing paper is packaged. In FIG. 16, a paper stack 1, consisting of sheets of sublimation type printing paper (image-receiving paper), is loosely packaged by a first packaging material 2. In other words, the first packaging material 2 is larger than the paper. The first packaging material 2 has a notch 2*a* and opening perforations 2*b*.

FIG. 17 is a perspective view illustrating another example of how a stack of conventional sublimation type printing paper is packaged. In FIG. 17, the paper stack 1 is closely packaged by a second packaging material 3. The second packaging material 3 has an opening ribbon 3*a*.

FIG. 18 is a plan view illustrating an example of a paper cassette for a printer. In FIG. 18, a side wall surface of a cassette body 4 is provided with positioning protrusions 4*a* which make contact with the rear end portion and two side surface portions of the printing paper. A pair of separating claws 5 are mounted in the cassette body 4 at positions where they make contact with the two corners of the forward end portion of the printing paper. The separating claws 5 separate the printing paper one by one when the paper is fed. Also, a pressure plate 6 on which the printing paper is placed is provided inside the cassette body 4. Springs 7 are provided between the cassette body 4 and the pressure plate 6 to urge the pressure plate 6 in the upward direction.

How the paper stack 1 is set in the paper cassette will be explained. In the case of the paper stack 1 packaged by the first packaging material 2 shown in FIG. 16, first, the first packaging material 2 is unsealed from the notch 2*a* along the perforations 2*b*. Next, the forward end portion of the paper stack 1 is placed in the cassette body 4 at a predetermined position with the paper stack 1 being held by hand in the remaining portion of the first packaging material 2, as shown in FIG. 19. Thereafter, the remaining portion of the first packaging material 2 is pulled out in the direction indicated by an arrow in FIG. 19.

In the case of the paper stack 1 packaged by the second packaging material 3 shown in FIG. 17, since the paper stack 1 is closely packaged by the packaging material 3, it is difficult to pull out the second packaging material 3 in the manner shown in FIG. 19. Hence, after the unsealing ribbon 3*a* is removed, the whole of the second packaging material 3 is peeled off the paper stack 1. Then, the paper stack 1 is placed in the cassette body 4 at a predetermined position with the paper stack 1 being directly held by hand, as shown in FIG. 20.

The paper cassette with the paper stack 1 set therein is loaded in a printer body 8, as shown in FIG. 21.

In the case of the conventional paper stack which is packaged by the first packaging material 2 shown in FIG. 16, since the paper stack 2 is loosely packaged, the end portion of the paper stack 1 may become irregular due to vibrations which occur during transportation or the like. To square the ends of the paper stack 1, the paper stack 1 must be handled by hand, making the printing surface (the dyeing surface) of the printing paper soiled by fats in fingerprints or the like. In the case of the conventional paper stack packaged by the second packaging material shown in FIG. 17, since the paper stack 1 is closely packaged, the corner portions of the second packaging material 3 may be damaged, thus damaging the printing paper. Furthermore, the paper stack 1 must be handled directly by hand, and this makes the printing surface of the printing paper soiled. Printing cannot be completely done on the printing paper whose printing surface is partially soiled. Consequently, the printing paper is wasted, and the printing quality deteriorates.

SUMMARY OF THE INVENTION

Accordingly, an object of the present invention is to provide a printing paper protecting device which is capable of reliably preventing soiling of the printing surface of printing paper so as to enhance the printing quality.

In order to achieve the above object, according to a first aspect of the present invention, there is provided a printing paper protecting device which comprises a protecting plate having a bending portion which is bent along an end portion of a paper stack, and a detecting portion which allows a sensor on a printer body to detect that the paper has run out. The protecting plate is placed on a printing surface of the paper stack and is accommodated in a paper cassette together with the paper stack.

According to a second aspect of the present invention, there is provided a printing paper protecting device which comprises a protecting plate having a bending portion which is bent along an end portion of a paper stack, a detecting portion which allows a sensor on a printer body to detect that the paper is out, and an engaging portion which engages with a paper cassette when accommodated in the paper cassette in a proper direction. The protecting plate is placed on a printing surface of the paper stack and is accommodated in the paper cassette together with the paper stack.

According to a third aspect of the present invention, there is provided a printing paper protecting device which comprises a reinforcing plate laid on a paper stack, and a packaging material having an unsealing portion. The paper stack and the reinforcing plate are closely packaged by the packaging material.

According to a fourth aspect of the present invention, there is provided a printing paper protecting device which comprises a packaging material having an unsealing portion which exposes a forward end portion side of a paper feed roller contact portion of a paper stack, and a positioning open portion which exposes a portion of the paper stack which makes contact with a paper cassette. The paper stack is packaged by the packaging material, and is accommodated in the paper cassette together with the packaging material.

In the printing paper protecting device according to the first aspect of the present invention, the paper stack is set in the paper cassette with the protecting plate laid on the printing surface thereof. Consequently, the printing surface is not touched by hand.

In the printing paper protecting device according to the second aspect of the present invention, the paper stack is set in the paper cassette with the protecting plate laid on the printing surface thereof. Consequently, the printing surface is not touched by hand. Furthermore, since the engaging portion is engaged with the paper cassette, erroneous setting of the paper stack is prevented.

In the printing paper protecting device according to the third aspect of the present invention, since the paper stack is closely packaged, shifting of the paper stack during transportation is prevented. Also, damage to the paper stack during transportation is prevented by the reinforcing plate. Furthermore, when the paper stack is set in the paper cassette, the reinforcing plate is pulled out to generate a space between the paper stack and the packaging material and thereby facilitate removal of the packaging material.

In the printing paper protecting device according to the fourth aspect of the present invention, since the paper stack is set in the paper cassette with the packaging material attached thereto, the printing surface of the paper stack is not touched by hand. Furthermore, since the portion of the paper stack which is exposed from the positioning open portion is directly brought into contact with the positioning portion of the paper cassette, reduction in the positioning accuracy of the paper stack is prevented.

DETAILED DESCRIPTION OF THE PREFERRED EMBODIMENTS

Figure 1:
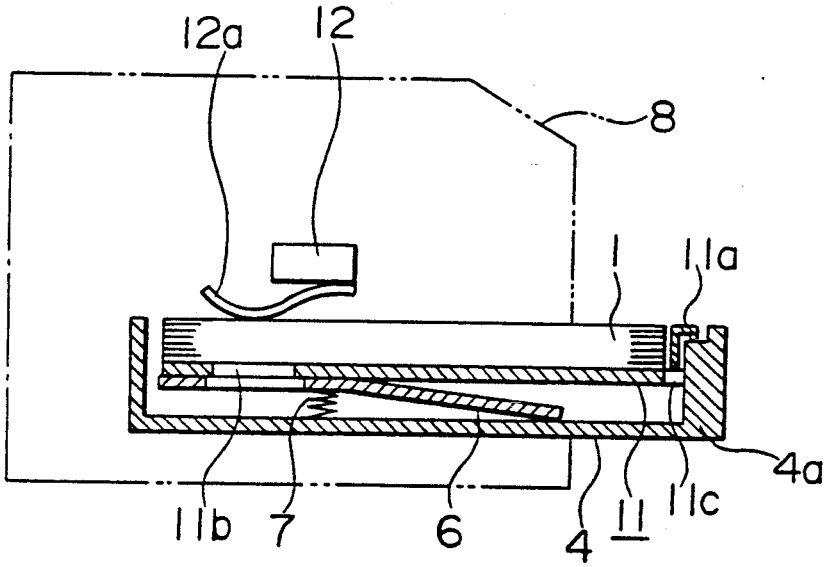
FIG. 1 is a cross-sectional view of the essential parts of a printer illustrating how a printing paper protecting device according to the first and second aspects of the present invention is used.

Preferred embodiments of the present invention will be described below with reference to the accompanying drawings. Reference numerals in these figures identical or corresponding to those in FIGS. 16 through 21 represent similar or identical elements, and description thereof is omitted.

FIG. 1 is a sectional view illustrating how a printing paper protecting device according to a first embodiment of the present invention is used.

Figure 2:
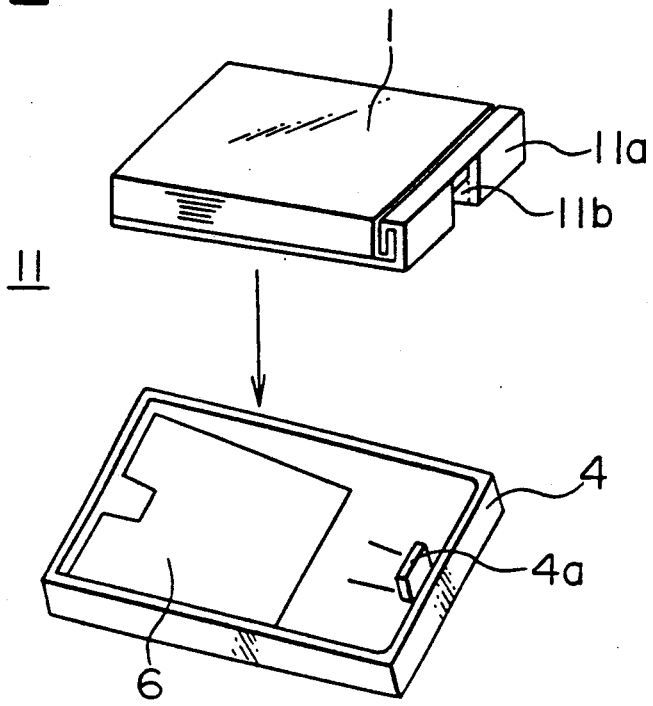
FIG. 2 is a perspective view illustrating how a paper stack and a protecting plate are set in a paper cassette.

In FIG. 1, a protecting plate 11 is placed in the paper cassette together with the paper stack 1 in such a manner that it is in contact with the end surface of the paper stack 1 on which printing is done, i.e., the undersurface of the paper stack 1. The protecting plate 11 has a bent portion 11*a* which is bent along the end portion of the paper stack 1, and an open portion 11*b* serving as a detection portion. The bent portion 11*a* defines a barrier opposing an end of the paper stack 1 transverse to the length of the paper. As shown in FIG. 2, the bent portion 11*a* includes a first wall extending substantially perpendicular to and from an end of the plate 11 transverse to the length direction of the plate, a second wall extending from the first wall towards the opposite end of the plate 11 and substantially parallel to the plate 11, and a third wall extending from the second wall towards and substantially perpendicular to the plate 11. The barrier comprises the third wall. The top surface of the second wall provides a grasping surface for grasping of the plate 11 by hand without contacting the paper in the stack 1. The bent portion 11*a* has an engaging portion 11*c* which engages with the positioning protrusion 4*a*. The printing paper protecting device according to this embodiment comprises the protecting plate 11. A sensor 12 for detecting the presence of the printing paper is provided on the printer body 8. The sensor 12 has an actuator 12*a* which contacts the printing paper.

The protecting plate 11 is packaged in a state wherein it is in contact with the paper stack 1 and such a package is carried from one place to another. As shown in FIG. 2, the protecting plate 11 is accommodated in the paper cassette together with the paper stack 1 after the package is completely removed therefrom. At that time, the printing surface (the undersurface) of the paper stack 1 is covered by the protecting plate 11 and soiling of the printing surface is thus prevented even when the paper stack 1 and the protecting plate 11 are handled by hand. Furthermore, the protecting plate 11 reinforces the paper stack 1 against the impacts which may be applied thereto during transportation and thereby prevents damage of the printing paper. Consequently, the printing quality is improved The positioning protrusion 4*a* shown in FIG. 2 is slidable so that it can be adjusted to the size of the paper accommodated in the cassette.

Figure 3:
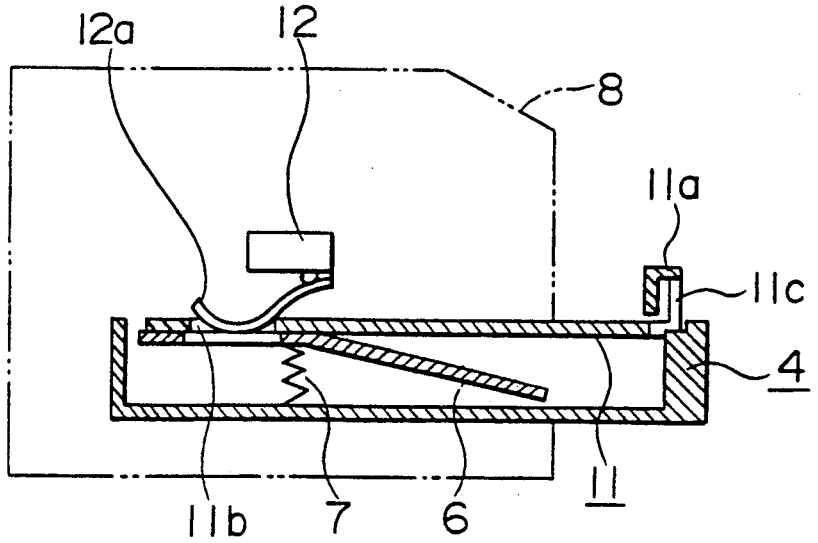
FIG. 3 is a sectional view illustrating the state in which the paper has run out in FIG. 1.

When all the printing paper has been fed out of the cassette, the actuator 12*a* falls into the open portion of the pressure plate 6, indicating that the paper has run out. In this embodiment, since the protecting plate 11 has the open portion 11*b* at a position where it opposes the open portion of the pressure plate 6, it does not hinder detection that the paper is out, as shown in FIG. 3.

Figure 4:
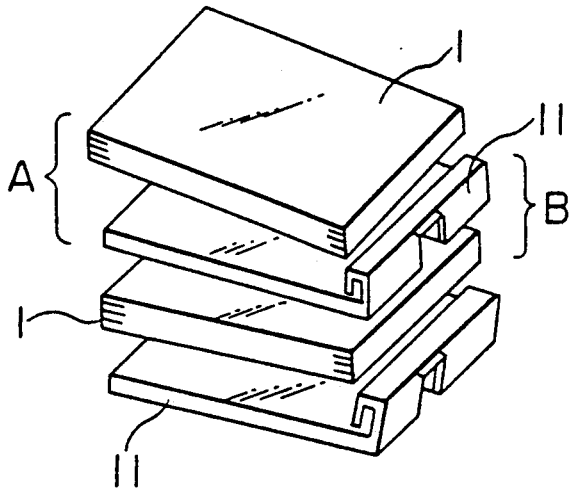
FIG. 4 is an exploded perspective view illustrating how a plurality of paper stacks are laid on top of another.
Figure 5:
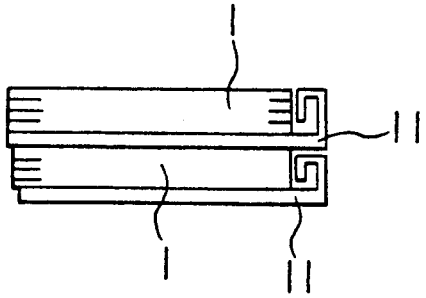
FIG. 5 is a side elevational view of FIG. 4.

In a case where the cassette has a capacity which allows, for example, 100 sheets of paper to be accommodated therein while a single printing paper package contains, for example, 200 sheets of paper, a single protecting plate 11 is provided for a individual paper stack 1 which contains 100 sheets of paper, as shown in FIGS. 4 and 5. In that case, when the paper stack 1 is set in the paper cassette, the paper stacks 1 each containing 100 sheets of paper must be separated one by one from the entire package shown in FIG. 4. The bending portion 11*a* provided on the protecting plate 11 makes this separation easy.

In FIG. 4, A represents a correct combination of the paper stack 1 and the protecting plate 11, and B represents an incorrect combination thereof. In a package in which many paper stacks 1 are laid on top of another, there is the possibility that the paper stack 1 and the protecting plate 11 will be separated and set in the paper cassette in a incorrect combination B. The protecting plate 11 according to the present embodiment has the engaging portion 11*c* which is brought into engagement with the positioning protrusion 4*a* of the paper cassette, and thereby prevents it from being accommodated in the paper cassette in the incorrect combination B. Thus, the paper stack 1 and the protecting plate are not set in the cassette in an incorrect combination. Also, they are not installed inside out. As a result, setting of the paper stack 1 in the paper cassette is facilitated, and workability is thus improved.

In this embodiment, a mechanical sensor 12 has been used. However, a reflection or transmission type optical sensor may also be employed.

Furthermore, in this embodiment, the open portion 11*b* is provided as the detection portion. However, the detection portion is not limited to this but it may be altered according to the type of sensor 12. When, for example, a reflection type optical sensor is employed, a black marking which suppresses reflection of the light is provided on the protecting plate 11 as the detection portion.

Furthermore, in this embodiment, the bent portion 11*a* is provided such that it runs along the rear end portion of the paper stack 1. However, it may be provided at other positions. Alternately, a plurality of bending portions 11*a* may be provided.

Furthermore, the protecting plate 11 according to this embodiment has the engaging portion 11*c* which engages with the positioning protrusion 4*a*. However, the protecting plate 11 may be engaged with another portion of the paper cassette or a protrusion provided on the paper cassette for this purpose.

Furthermore, there is no limitation to the material of the protecting plate 11. For example, a protecting plate 11 made of plastic or thick paper may be used.

Figure 6:
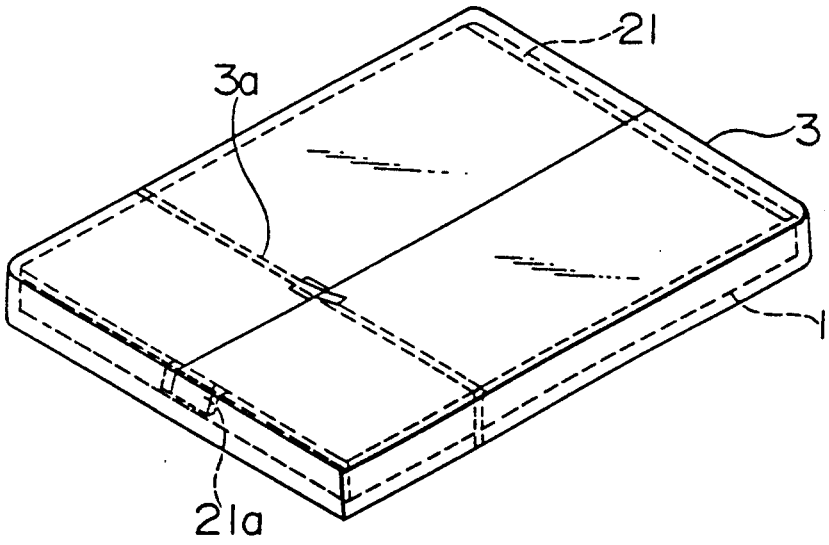
FIG. 6 is a perspective view illustrating how a paper stack is packaged using a printing paper protecting device according to the third aspect of the present invention.

FIG. 6 is a perspective view illustrating how a paper stack is packaged using the printing paper protecting device according to a second embodiment of the present invention.

In FIG. 6, a reinforcing plate (protector) 21 is laid on top of the paper stack 1. The reinforcing plate 21 has a tab 21*a* which is bent along the end portion of the paper stack 1. The paper stack 1 and the reinforcing plate 21 are closely packaged by the second packaging material 3. The printing paper protecting device according to the present embodiment comprises the reinforcing plate 21 and the second packaging material 3.

Figure 7:
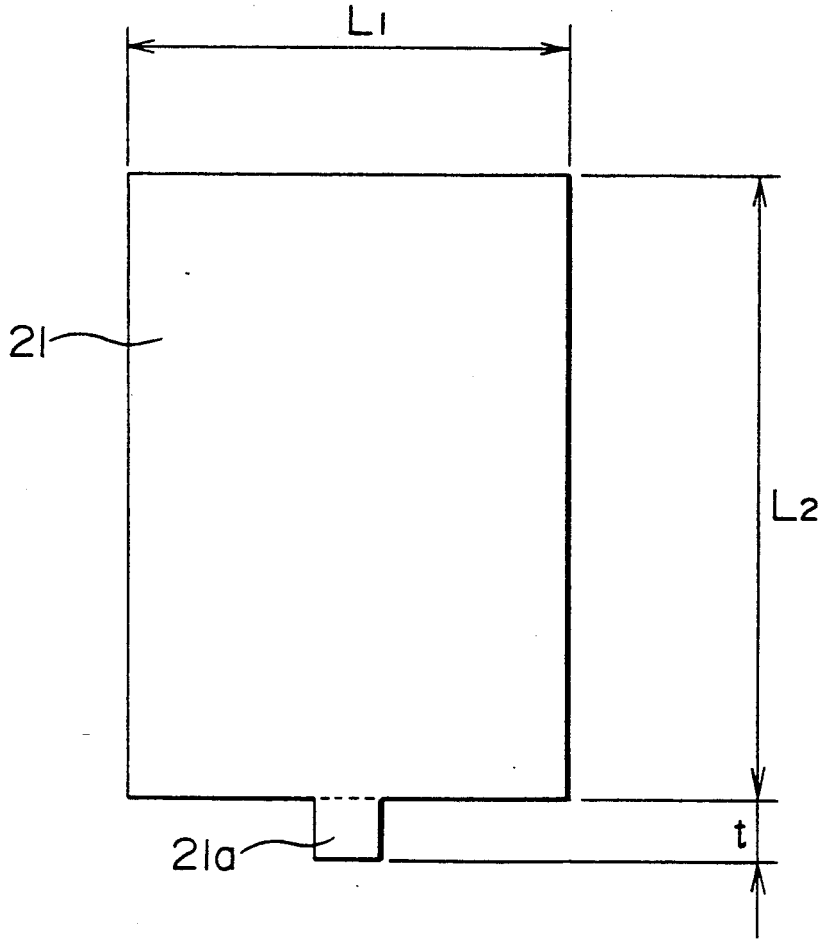
FIG. 7 is a plan view of a reinforcing plate of FIG. 6.

FIG. 7 is a plan view of the reinforcing plate 21 of FIG. 6. The length $L_1$ of the shorter side of the reinforcing plate 21 is the same as the length of the shorter side of the paper stack 1, and the length $L_2$ of the longer side of the reinforcing plate 21 is the same as that of the longer side of the paper stack 1. The length t of the tab 21 is equal to or less than the thickness of the paper stack 1.

Figure 8:
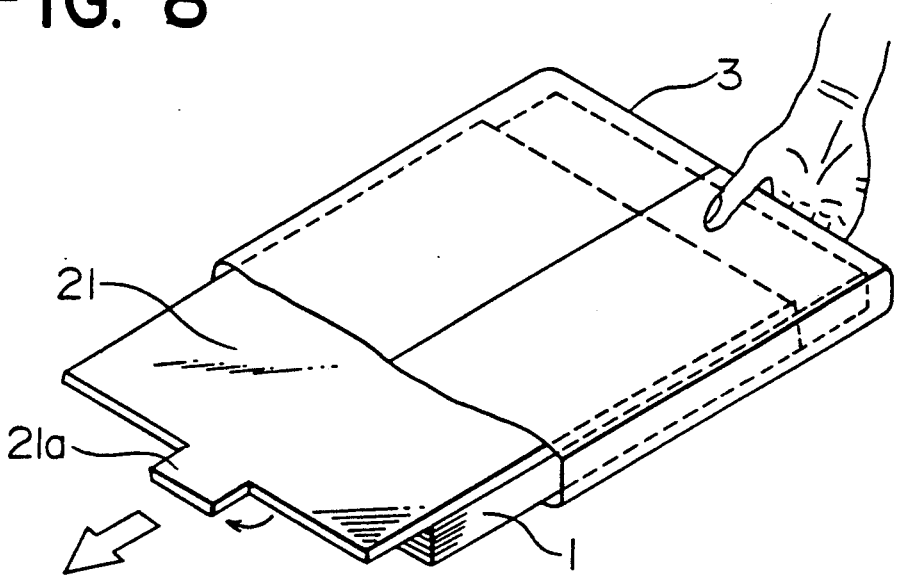
FIG. 8 is a perspective view illustrating how the reinforcing plate is pulled out from the packaging material.
Figure 9:
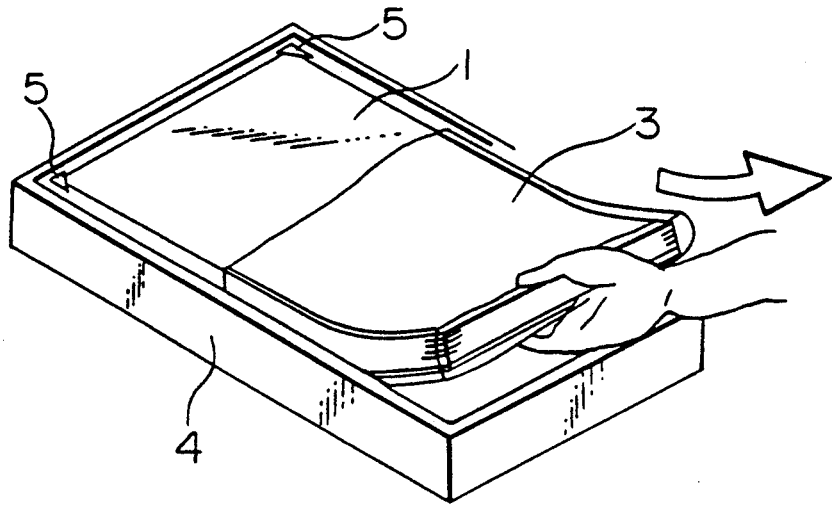
FIG. 9 is a perspective view illustrating how the paper stack of FIG. 6 is set in the paper cassette.

When the paper stack 1 packaged in the manner described above is to be set in a paper cassette, first, the end portion of the second packaging material 3 is unsealed by removing an unsealing ribbon 3*a* serving as the unsealing portion to expose the forward end portion (which is equal to or less than half of the entire length) of the printing paper. Next, as shown in FIG. 8, the reinforcing plate 21 is pulled out from the second packaging material 3 by pulling the tab 21*a*, whereby a space is generated between the second packaging material 3 and the paper stack 1. As shown in FIG. 8, the tab 21*a* can be bent from the position shown in FIG. 6 to a position in which it is substantially parallel to the surface of the plate 21 without breaking. In that state, the forward end portion of the paper stack 1 is placed in the cassette body 4 at a predetermined position with the paper stack 1 being held by hand in the remaining portion of the second packaging material 3, as shown in FIG. 9. Thereafter, the second packaging material 3 is pulled out in the direction indicated by the arrow.

In the aforementioned printing paper protecting device, since the paper stack 1 is closely packaged by the second packaging material 3, the edges of the paper stack 1 remain flush during transportation. Furthermore, since the paper stack 1 is reinforced by the reinforcing plate 21 which is laid on top thereof, it is not damaged by the impacts applied thereto during transportation or the like. Furthermore, since there is a space between the paper stack 1 and the second packaging material 3 in the package from which the reinforcing material 21 has been pulled out, the paper stack 1 can be set in the paper cassette without the whole of the second packaging material 3 being removed and without the paper stack 1 being directly held by hand. Thus, soiling of the printing surface of the printing paper can be prevented, and the printing quality is thus improved.

A reinforcing material 21 made of thick paper or a plastic may also be used.

Figure 10:
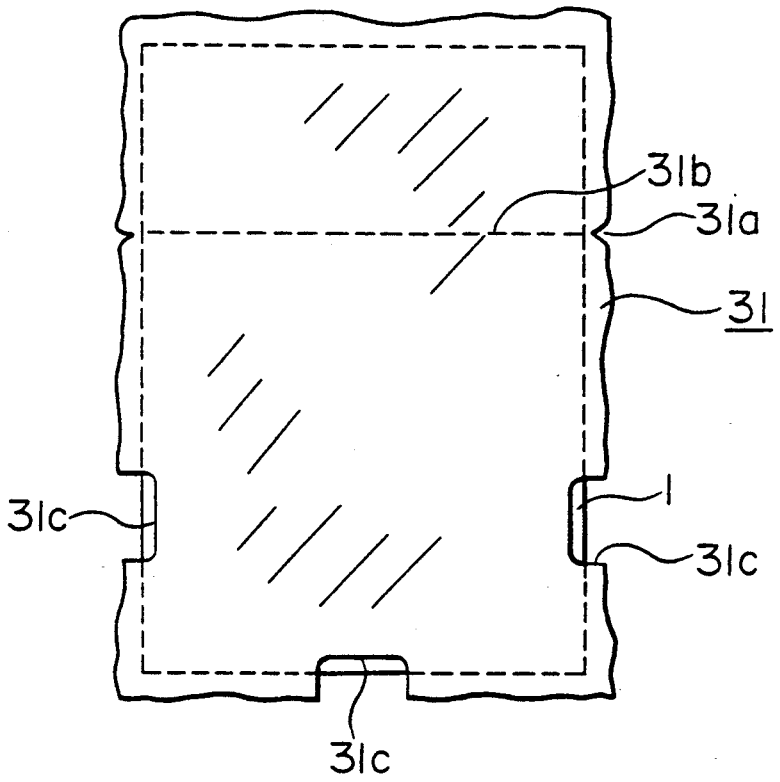
FIG. 10 is a plan view illustrating how the paper stack is packaged using the printing paper protecting device according to the fourth aspect of the present invention.

FIG. 10 is a plan view illustrating how a paper stack is packaged using the printing paper protecting device according to a third embodiment of the present invention.

In FIG. 10, the paper stack 1 is loosely packaged by a third flexible packaging material 31. The third packaging material 31 has notches 31*a* and perforations 31*b* which allow the forward end portion side of the paper feed roller contact portion of the paper stack 1 to be exposed. Also, the two side portions and the rear end portion of the third packaging material 31 are provided with positioning open portions 31*c* which allow the portions of the paper stack 1 which contact the paper cassette to be partially exposed. The printing paper protecting device according to the third embodiment comprises the third packaging material 31.

Figure 11:
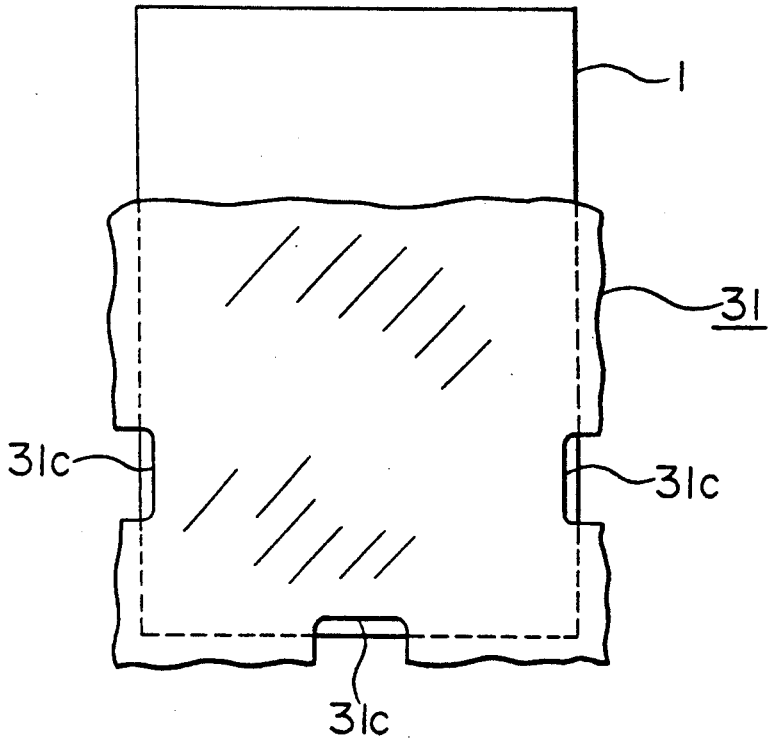
FIG. 11 is a plan view illustrating how the packaging material of FIG. 10 is unsealed.
Figure 12:
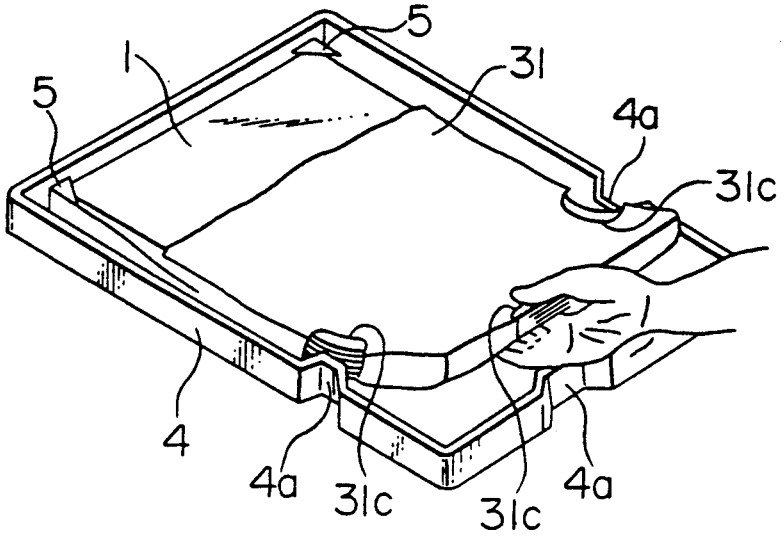
FIG. 12 is a perspective view illustrating how the paper stack of FIG. 10 is supplied to the paper cassette.

When the paper stack 1 packaged in the manner described above is to be set in a paper cassette, first, the third packaging material 31 is unsealed along the perforations 31*b* from either of the notches 31*a* to expose the forward end portion of the paper stack 1, as shown in FIG. 11. Next, as shown in FIG. 12, the paper stack 1 is placed in the paper cassette at a predetermined position with the paper stack 1 being held by hand in the remaining portion of the third packaging material 31. At that time, the remaining portion of the third packaging material 31 is not pulled out but is left in the paper cassette together with the paper stack 1.

Figure 13:
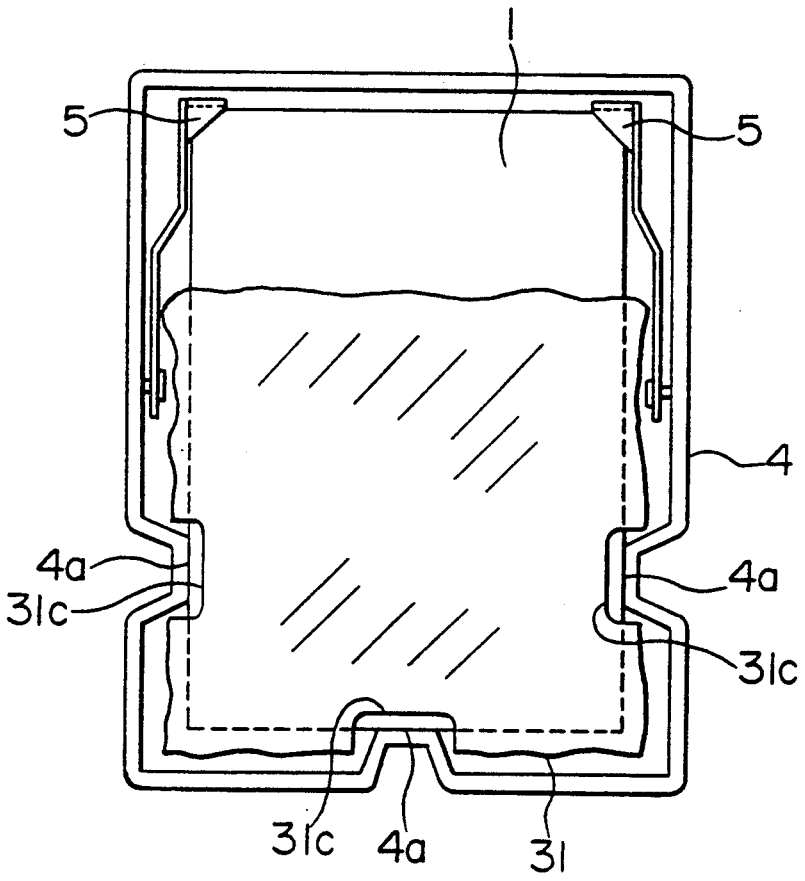
FIG. 13 is a plan view illustrating the paper stack of FIG. 10 is set in the paper cassette.

Most of the paper stack 1 is enclosed by the third packaging material 31 even after the paper stack 1 has been set in the paper cassette. Thus, soiling of the printing surface of the printing paper is prevented, and the printing quality is thus improved. Furthermore, since the positioning open portions 31*c* are provided, as shown in FIG. 13, the paper stack 1 makes direct contact with the positioning protrusions 4*a*. Consequently, the paper stack 1 can be accurately positioned, and jamming or oblique feeding of the printing paper can thus be prevented.

Figure 14:
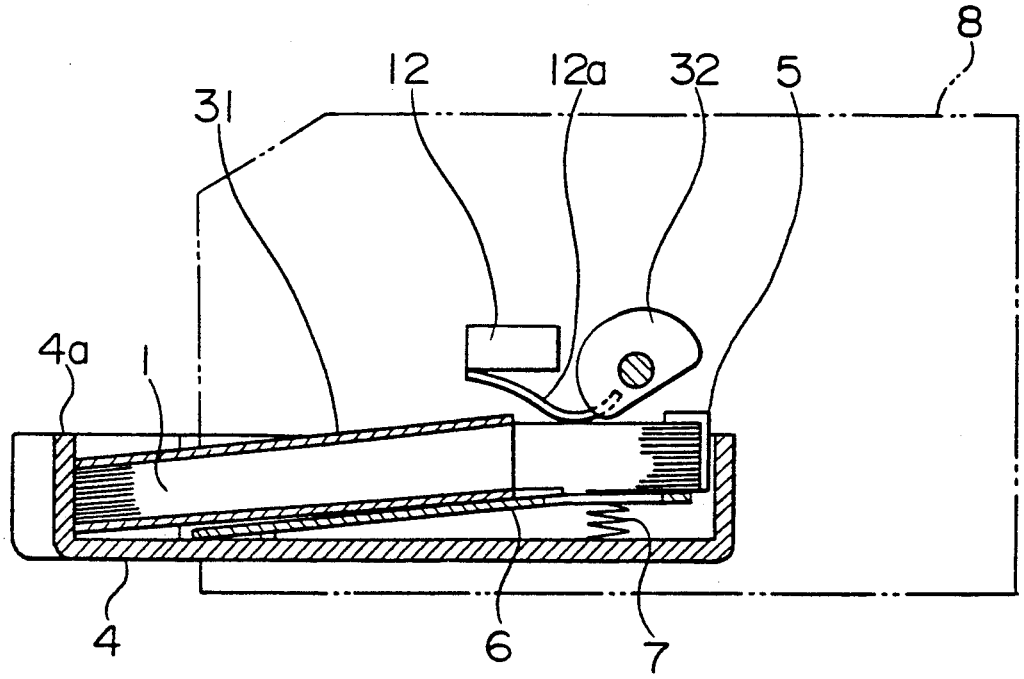
FIG. 14 is a cross-sectional view illustrating how the paper cassette of FIG. 13 is loaded in a printer body.

Furthermore, in the state wherein the paper cassette is loaded in the printer body 8, as shown in FIG. 14, a paper feeding roller 32 and the actuator 12*a* of the sensor 12 make contact with the exposed forward end portion of the paper stack 1. Consequently, the third packaging material 31 does not hinder detection of the paper end.

Figure 15:
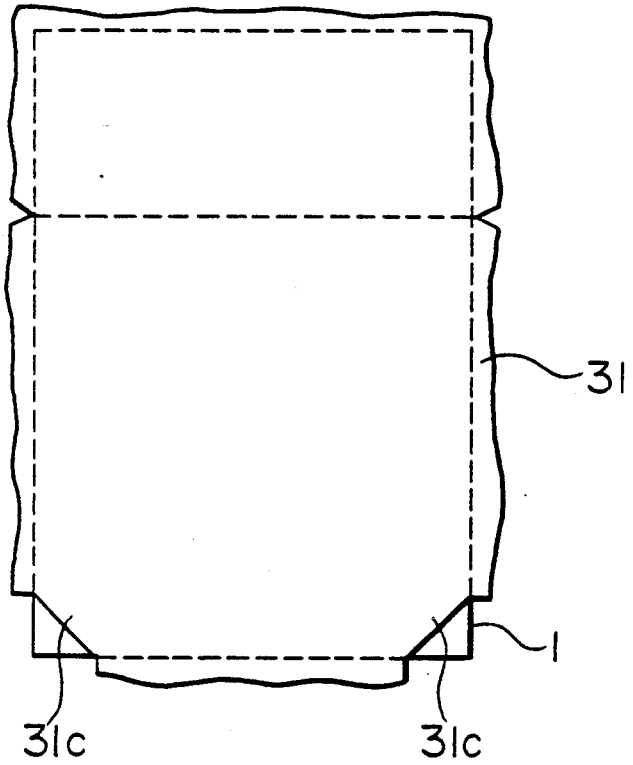
FIG. 15 is a plan view of a modification according to the fourth aspect of the present invention.
Figure 16:
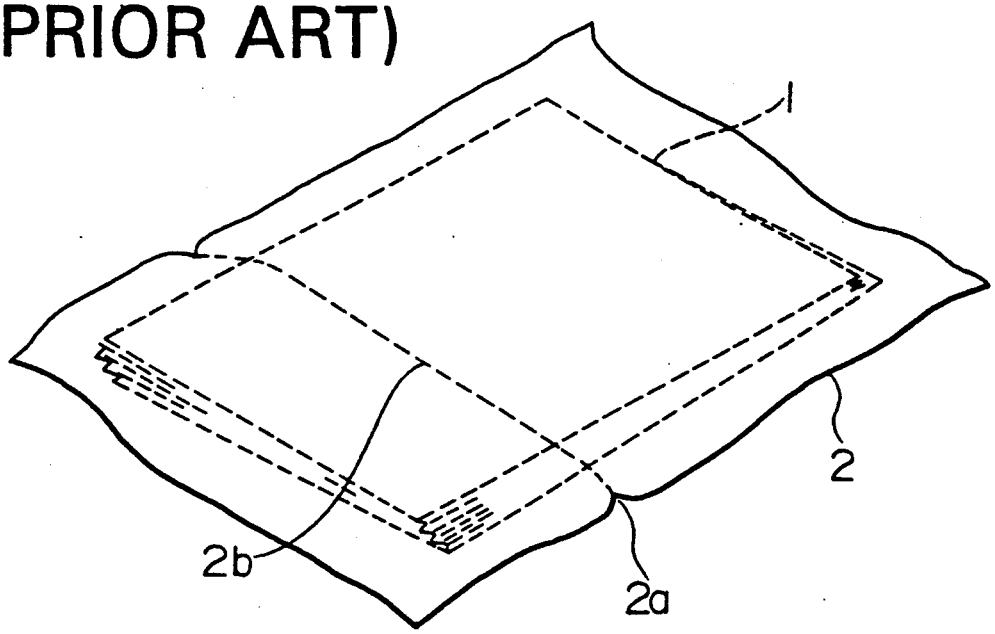
FIG. 16 (PRIOR ART)
FIG. 16 is a perspective view illustrating an example of how a stack of conventional printing paper is packaged.
Figure 17:
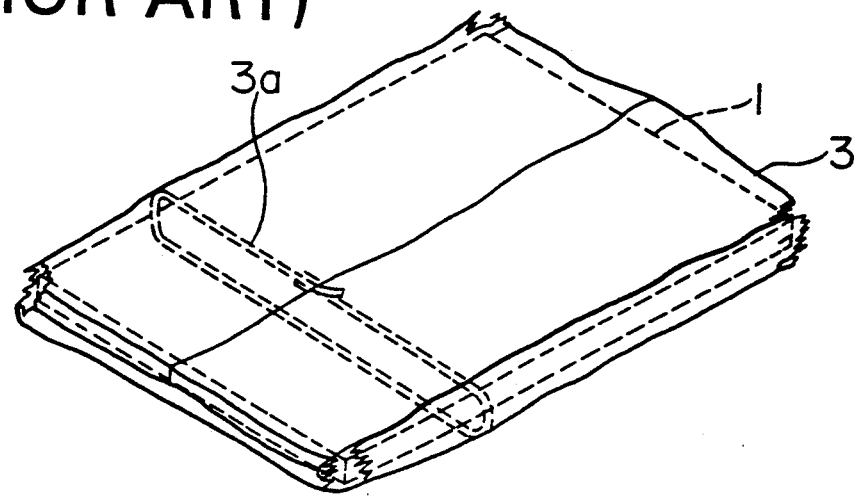
FIG. 17 (PRIOR ART)
FIG. 17 is a perspective view illustrating another example of how a stack of conventional printing paper is packaged.
Figure 18:
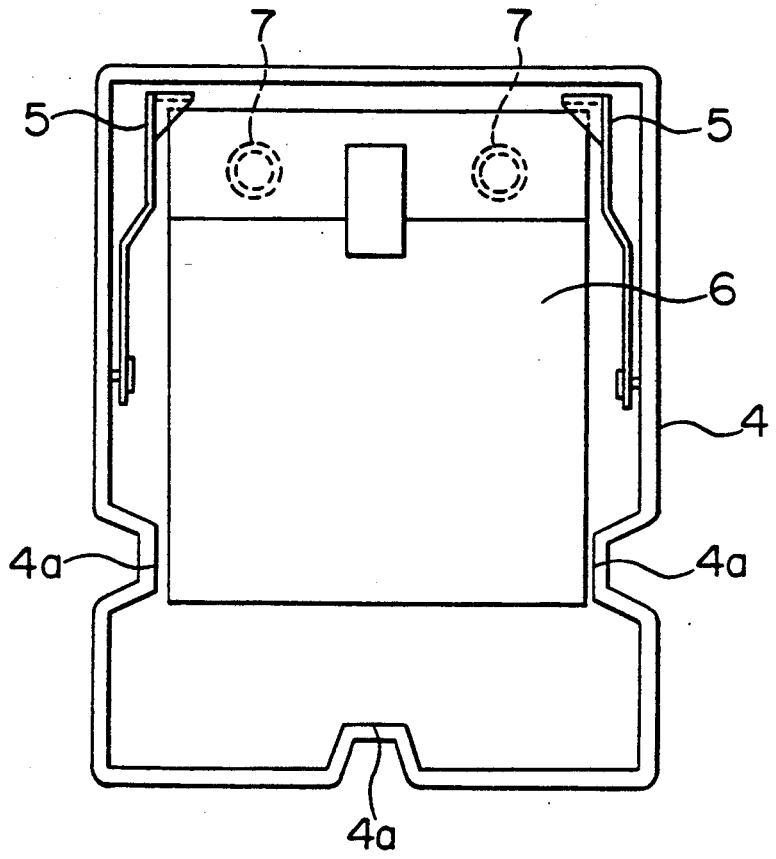
FIG. 18 (PRIOR ART)
FIG. 18 is a plan view of an example of a paper cassette for a printer.
Figure 19:
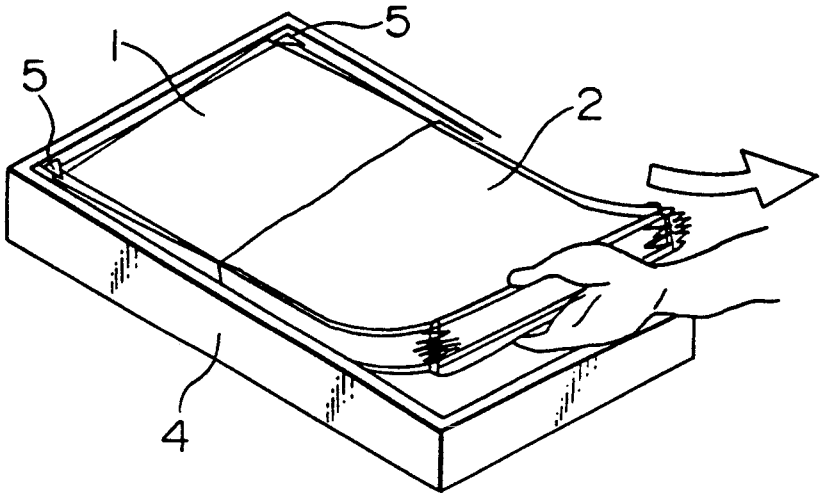
FIG. 19 (PRIOR ART)
FIG. 19 is a perspective view illustrating how the paper stack packaged by the packaging material of FIG. 16 is set in the paper cassette of FIG. 18.
Figure 20:
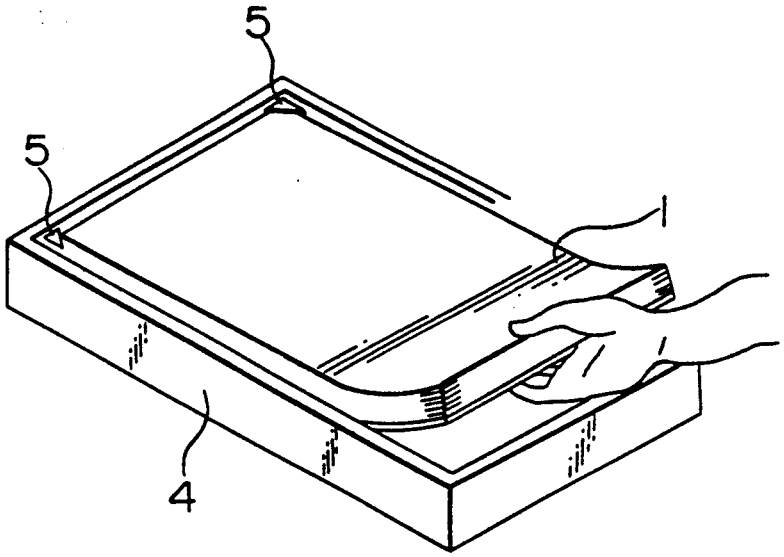
FIG. 20(PRIOR ART)
FIG. 20 is a perspective view illustrating how the paper stack packaged by the packaging material of FIG. 17 is set in the paper cassette of FIG. 18.
Figure 21:
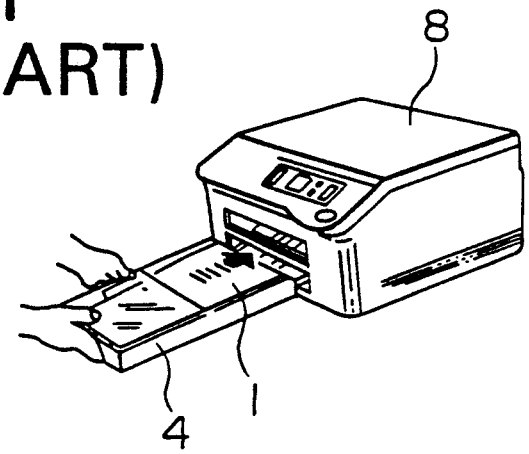
FIG. 21 (PRIOR ART)
FIG. 21 is a perspective view illustrating how the paper cassette of FIG. 18 is loaded in the printer body.

The shape, number and position of the positioning open portions 31*c* are determined according to the paper cassette and are not limited to those of this embodiment. For example, a positioning open portion 31*c* may be provided at each of the corner portions, as shown in FIG. 15.

A positioning open portion 31*c* may be designed to be opened along perforations when the paper stack 1 is set in the paper cassette so that dust does not enter therefrom during transportation. Alternatively, the entire package shown in FIG. 10 may be double-packaged for transportation.

Furthermore, the unsealing portion is not limited to the unsealing perforations 31*b* but may be an unsealing ribbon.

The third packaging material 31 which is closely attached to the paper stack 1 hinders initial paper feeding. Therefore, loose packaging of the paper stack 1 is desirable.

Since the third packaging material 31 of this embodiment is set in the paper cassette together with the paper stack 1, if the front or rear of the printing paper is printed on the third packaging material 31, erroneous setting of the paper stack 1 can be easily prevented.

In the aforementioned embodiments, sublimation type printing paper has been used. However, the printing paper is not limited to this but, for example, an overhead projection (OHP) film may be employed.

As will be understood from the foregoing description, in the printing paper protecting device according to the first aspect of the present invention, a protecting plate is placed on the printing surface of a printing stack and is accommodated in a paper cassette together with the paper stack. Consequently, it is not necessary for the user to directly touch the printing surface, and soiling of the printing surface of the printing paper can thus be reliably prevented. As a result, waste of the printing paper can be eliminated, and the printing quality can be improved. Furthermore, since the protecting plate has a bent portion, the paper stack can be easily separated from other paper stacks. Furthermore, since the protecting plate has a detecting portion it does not hinder detection that the paper is out.

The aforementioned protecting plate has an engaging portion which engages with the paper cassette when the protecting plate is suitably accommodated in the paper cassette. Thus, erroneous setting of the paper stack can be prevented.

In the printing paper protecting device according to the second aspect of the present invention, a reinforcing plate is laid on a paper stack, and the paper stack and the reinforcing plate are closely packaged by packaging material having an unsealing portion at one end portion thereof. Consequently, shift of or damage to the paper stack during transportation can be prevented, and the packaging material can be easily removed by pulling out the reinforcing plate. As a result, soiling of the printing surface of the printing paper can be reliably prevented, and waste of the printing paper can be eliminated while the printing quality can be improved.

In the printing paper protecting device according to the third aspect of the present invention, since a paper stack is accommodated in a paper cassette in a state in which it is packaged by packaging material, it is not necessary for the user to directly touch the printing surface, and soiling of the printing surface of the printing paper can thus be reliably prevented. As a result, waste of the printing paper can be eliminated, and the printing quality can be improved. Also, since the packaging material has an unsealing portion which exposes the forward end portion of the paper feed roller contact portion of the paper stack, and a positioning open portion which exposes the portion of the paper stack which makes contact with the paper cassette, it does not hinder paper feeding or positioning.

What is claimed is:

1. A printing paper protecting device comprising:

a paper cassette for holding a stack of printing paper; and a printing paper support removably disposed in the cassette and including:

a flat protecting plate having a length direction and a width direction; the first and second ends begin and first and second ends transverse to the length direction disposed within the cassette, and a support surface for receiving a stack of paper, a barrier extending along the width direction of the plate and extending substantially perpendicular to the support surface, and a grasping surface adjoining the first end of the plate for enabling the paper support to be grasped by a hand without contacting a stack of paper disposed on the paper support.

2. A device as claimed in claim 1 wherein the barrier is integral with the plate.

3. A device as claimed in claim 1 wherein the paper support includes a first wall extending substantially perpendicular to the plate at the first end of the plate and a second wall extending from the first wall towards the second end of the plate substantially parallel to and spaced from the plate; the barrier comprises a third wall extending form the second wall towards and substantially perpendicular to the plate; and the grasping surface comprises an outer surface of the second wall.

4. A device as claimed in claim 1 wherein the plate extends along a length direction of a stack of paper disposed on the paper support.

5. A device as claimed in claim 1 wherein the paper support has an open side adjoining the second end of the plate and open sides extending between the first and second ends of the plate.

6. A device as claimed in claim 1 wherein the cassette includes a first engaging portion and the plate includes a second engaging portion engaging the first engaging portion only when the plate is disposed in the cassette with the first and second ends of the plate oriented in prescribed directions.

7. A device as claimed in claim 1 wherein the second engaging portion comprises a hole in the plate at the first end.

8. A device as claimed in claim 1 wherein the barrier is spaced from the first end of the plate.

9. A device as claimed in claim 1 comprising:

a hole in the plate beneath a stack of paper disposed on the paper support; and detecting means for detecting when no paper remains on the paper support, exposing the hole.

10. A device as claimed in claim 1 wherein the cassette has a lower surface, and the plate is supported by the cassette for movement within the cassette in a direction normal to the lower surface.

11. A printing paper protecting device comprising:

a paper support including:

a substantially flat plate having a length direction and a width direction and first and second ends transverse to the length direction, a detecting hole, and an engaging hole at the first end, and a first wall extending substantially perpendicular to and form the first end of the plate, a second wall extending from the first wall toward the second end of the plate substantially parallel to the plate, and a third wall extending from the second wall towards and substantially perpendicular to the plate, the first wall having an engaging hole adjoining the engaging hole in the plate.

12. A printing paper protecting device comprising:

a substantially flat reinforcing plate having a length direction and a width dimension and a first end transverse to the length direction and having a bendable tab;

a stack of paper contacting the plate and having a first end surface, the tab extending form the plate over the first end surface of ht stack of paper; and a packing material enveloping the plate and the stack of paper and including opening mean for removing a portion of the packing material to expose the first end of the plate and the stack of paper.

13. A device as claimed in claim 12 wherein the tab is integral with the plate.

14. A device as claimed in claim 12 wherein the tab is bendable from a position extending over the first lengthwise end surface of the stack of paper to a position substantially parallel to the plate without breaking.

15. A printing paper protecting device comprising:

a stack of paper having a top surface, first and second sides along a length direction of the stack, and first and second ends along a width direction of the stack; and a flexible packing material enveloping the stack of paper and including opening means for opening a portion of the packing material to expose the first end of the stack of paper, the pacing material further including first and second openings exposing the first and second sides of the stack of paper, each of the first and second openings having a length shorter than the first and second sides, respectively.

16. A device as claimed in claim 15 wherein the packing material includes a third opening exposing the top surface of the stack of paper along the second end, wherein the third opening has a width less than a width of the stack of paper.

17. A device as claimed in claim 16 wherein the stack of paper has a thickness, and the third opening extends entirely over the thickness.

18. A device as claimed in claim 15 wherein the first and second openings extend across corners of the stack of paper between the second end and the first and second sides of the stack of paper, respectively.

19. A printing paper protecting device comprising:

a paper cassette having lateral sides and projections extending form the lateral sides for positioning a stack of paper;

a stack of paper disposed in the cassette, the stack of paper having a top surface, first and second parallel sides opposing the projections of the cassette, and first and second ends transverse to the sides; and a packing material disposed in the cassette and enveloping the first end of the stack and exposing the second end of the stack and including first and second openings exposing the first and second sides of the stack of paper adjoining the projections.

20. A device as claimed in claim 19 wherein the packing material includes a third opening exposing the top surface of the stack of paper at the first end.

* * * * *

UNITED STATES PATENT AND TRADEMARK OFFICE

CERTIFICATE OF CORRECTION

PATENT NO. : 5,314,179

DATED : May 24, 1994

INVENTOR(S) : Oda et al.

It is certified that error appears in the above-indentified patent and that said Letters Patent is hereby corrected as shown below:

line 66, change "form" to --from--.

Column 9, line 35, change "form" to --from--;

line 49, change "ht" to --the--.

Column 10, line 17, change "pacing" to --packing--.

Signed and Sealed this

Eighteenth Day of October, 1994

Bruce Lehman

*Attest:*

BRUCE LEHMAN

*Attesting Officer*

*Commissioner of Patents and Trademarks*